US007037220B1

(12) United States Patent
Gordon

(10) Patent No.: US 7,037,220 B1
(45) Date of Patent: May 2, 2006

(54) SPORTS PLAY POOL

(76) Inventor: Donald W. Gordon, 994 E. New Hope St., Draper, UT (US) 84020

( * ) Notice: Subject to any disclaimer, the term of this patent is extended or adjusted under 35 U.S.C. 154(b) by 0 days.

(21) Appl. No.: 10/421,056

(22) Filed: Apr. 22, 2003

Related U.S. Application Data

(60) Provisional application No. 60/374,664, filed on Apr. 22, 2002.

(51) Int. Cl.
*A63B 67/00* (2006.01)

(52) U.S. Cl. ..... 473/466; 446/153

(58) Field of Classification Search ..... 473/466, 473/465, 415, 479, 480, 481; 273/386, 336, 273/394; 4/499, 488, 506; 52/169.2; 256/25; 446/153

See application file for complete search history.

(56) References Cited

U.S. PATENT DOCUMENTS 2,958,872 A * 11/1960 Meyer, Jr. ..... 4/503
3,351,323 A * 11/1967 Spencer ..... 256/25
3,363,268 A * 1/1968 Friedlander ..... 4/506
4,307,887 A * 12/1981 Weiss ..... 473/466
4,433,838 A 2/1984 Gordon
4,569,515 A 2/1986 Gordon
5,149,086 A * 9/1992 Ziff ..... 473/481
5,316,315 A 5/1994 Roark, Jr.
5,375,849 A 12/1994 Sabourin
5,615,891 A 4/1997 Pankz
5,980,401 A * 11/1999 Erlewine ..... 473/481
6,053,845 A * 4/2000 Publicover et al. ..... 482/35
6,220,975 B1 4/2001 Beazley
2004/0107491 A1* 6/2004 Publicover ..... 4/498

OTHER PUBLICATIONS

Welcome to Jumingjacz, 10 pages—May 2, 2000, [retrieved on May 10, 2004]. Retrieved from the Internet <URL:www.jumpingjacz.freeola.net/home.htm>.*

* cited by examiner

*Primary Examiner*—Eugene Kim
*Assistant Examiner*—M. Chambers
(74) *Attorney, Agent, or Firm*—Thorpe North & Western, LLP; Robert R. Mallinckrodt

(57) ABSTRACT

A supporting frame with netting material is placed around a swimming pool, either an in ground pool or an above ground pool, to at least partially enclose the pool and provide for the attachment and support of sport apparatus such as basketball, aeroball, and/or water polo goals at opposite sides or ends of the pool and such as a volleyball net stretched across the pool. The netting material may extend along the ends of the pool, around the entire periphery of the pool, and, if desired, across the top of the pool. The netting material ensures that lose sport apparatus, such as balls, used with the attached sport apparatus that contacts the netting material remains in the pool. The supporting frame includes support members that are secured to the pool. If the pool is an above ground pool, the support members are secured to the pool structure. The support members may be substantially rigid members or inflatable members.

11 Claims, 8 Drawing Sheets

SPORTS PLAY POOL

RELATED APPLICATION

Figure 1:
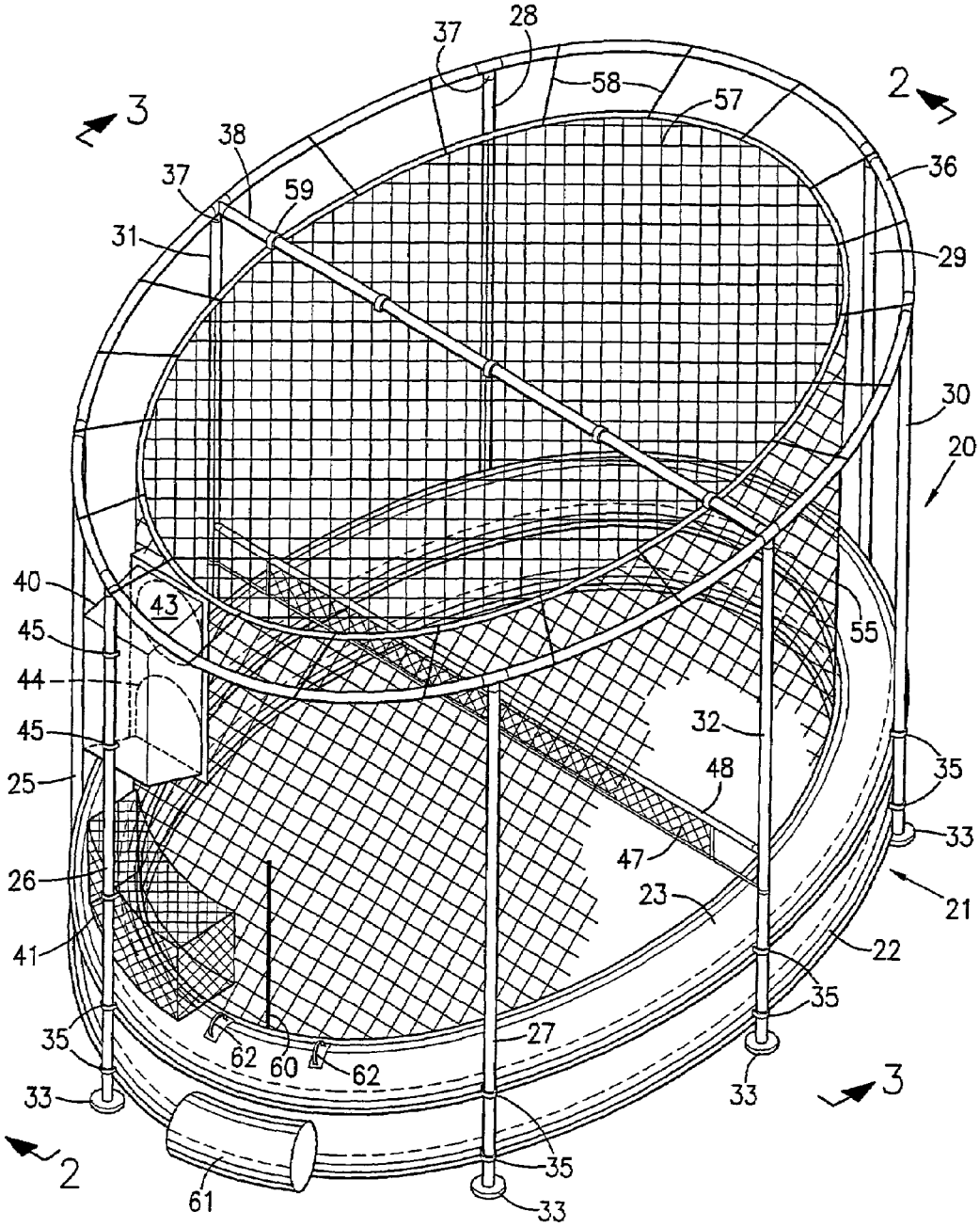

This application claims the benefit of provisional Application Ser. No. 60/374,664, filed Apr. 22, 2002, and entitled Sports Play Pool.

BACKGROUND OF THE INVENTION

1. Field

The invention is in the field of game playing apparatus for use with swimming pools, both above ground and in-ground pools, and particularly game apparatus such as nets, goals, and hoops supported above the top of the pool.

2. State of the Art

Swimming pools are very popular in the United States. Traditional swimming pools are dug into and formed in the ground so the top of the pool is approximately around ground level. This makes it easy to enter and exit from the pool. Also, since the sides of the pool are supported by the ground surrounding the pool, certain well developed types of construction for the pool can be used. Because of this, pools of any desired size can be constructed. Above ground pools are now also popular. While above ground pools used to be limited to small wading pools for children, methods of constructing pool sides have advanced to allow large above ground swimming pools to be constructed. Such above ground pools are generally constructed using self supporting inflatable sides or sides supported by frame members such as steel supporting frame members. The steel supporting frames generally support a flexible fabric reinforced plastic liner which holds the water.

The primary purpose of a swimming pool is to provide a body of water for people to immerse themselves in on hot days and for people to be able to swim in for pleasure and exercise. To increase the utility of swimming pools and provide group activities, various competitive games have developed involving from two to many participants. Many of these games are similar to existing games and require special equipment such as volleyball nets or basketball hoops. For example, U.S. Pat. No. 5,316,315 shows installation of a volleyball net and basketball hoops in a standard in ground swimming pool deck and U.S. Pat. No. 6,220,975 shows a goal such as a water polo goal which rests on a standard in ground swimming pool deck. U.S. Pat. No. 5,615,891 shows a volleyball net with one net support floating in the pool. U.S. Pat. No. 4,307,887 shows opposite upright stanchions attached to opposite sides of a round above ground pool which curve inwardly at the top to support basketball type backboards over the water of the pool and also support a volleyball net between the stanchions. U.S. Pat. No. 5,149,086 shows a basketball hoop and backboard assembly for attachment to the top rail of an above ground swimming pool. U.S. Pat. No. 5,375,849 shows a cable stretched between two poles on opposite sides of an above ground swimming pool which acts as a volleyball net with a ball tethered to the cable. With all of these, except U.S. Pat. No. 5,375,849 which shows a tethered ball for playing volleyball, the ball is free to be thrown out of the pool if the goal and backboard is missed or if a volleyball hit or basketball block misdirects the ball. Someone then has to climb out of the pool to retrieve the ball.

While various net enclosures have been developed for trampolines, such as shown in U.S. Pat. No. 6,053,845 and in my U.S. Pat. Nos. 4,433,838 and 4,569,515, trampolines are relatively small structures much different than swimming pools in both size and use. In a pool, the user is in the water below the top of the pool rather than jumping on a rebound surface above the pool.

SUMMARY OF THE INVENTION

According to the invention, frame or support members extend upwardly above a swimming pool, which may be an above ground or in ground pool, to support sport apparatus such as a volleyball net, basketball hoop, water polo goal, or aeroball goal, in play position above the pool. Netting material is also supported by the support or frame members around at least portions of the periphery of the pool to form backstops to prevent loose sport apparatus used in conjunction with the supported sport apparatus in play of the sport involved, such as a ball, from leaving the pool. For many sports, it will be preferred to completely enclose the pool around its periphery. Depending upon the height of the netting material, netting material may extend across the top of the pool as well as around the periphery.

For an in ground pool, the support members will be, either permanently or removably, secured in the pool deck, the number of support members depending upon the size of the pool. Generally there will be at least two spaced support members at each end of the pool for supporting sport apparatus such as basketball hoops, water polo goals, or aeroball goals at opposite ends of the pool, and two support members midway between the ends of the pool to support a volley ball net stretched across the pool. Some or all of the support members also support the netting material. Alternatively, the frame may be placed as a unit over the pool and not actually secured to the deck.

For an above ground pool, the support members will generally be secured to, or at least positioned by, the sides of the pool. The number of support members will again depend upon the size of the pool. Generally there will be at least two spaced support members at each end of the pool for supporting sport apparatus such as basketball hoops, water polo goals, or aeroball goals at opposite ends of the pool, and two support members midway between the ends of the pool to support a volley ball net stretched across the pool. These support members also support the netting material. The support members may be rigid support members which form a substantially rigid support frame above the pool, or may be inflatable support members. When the above ground pool is a substantially rigid frame pool, the support members will usually be rigid members either supported by the ground on which the pool rests and secured to the pool frame to position and hold the support members, or secured to and supported by the pool frame. When the above ground pool is an inflatable pool, the support members may be inflatable tubular members that extend from the top of the inflatable side walls of the pool and may join above the center of the pool.

THE DRAWINGS

Figure 2:
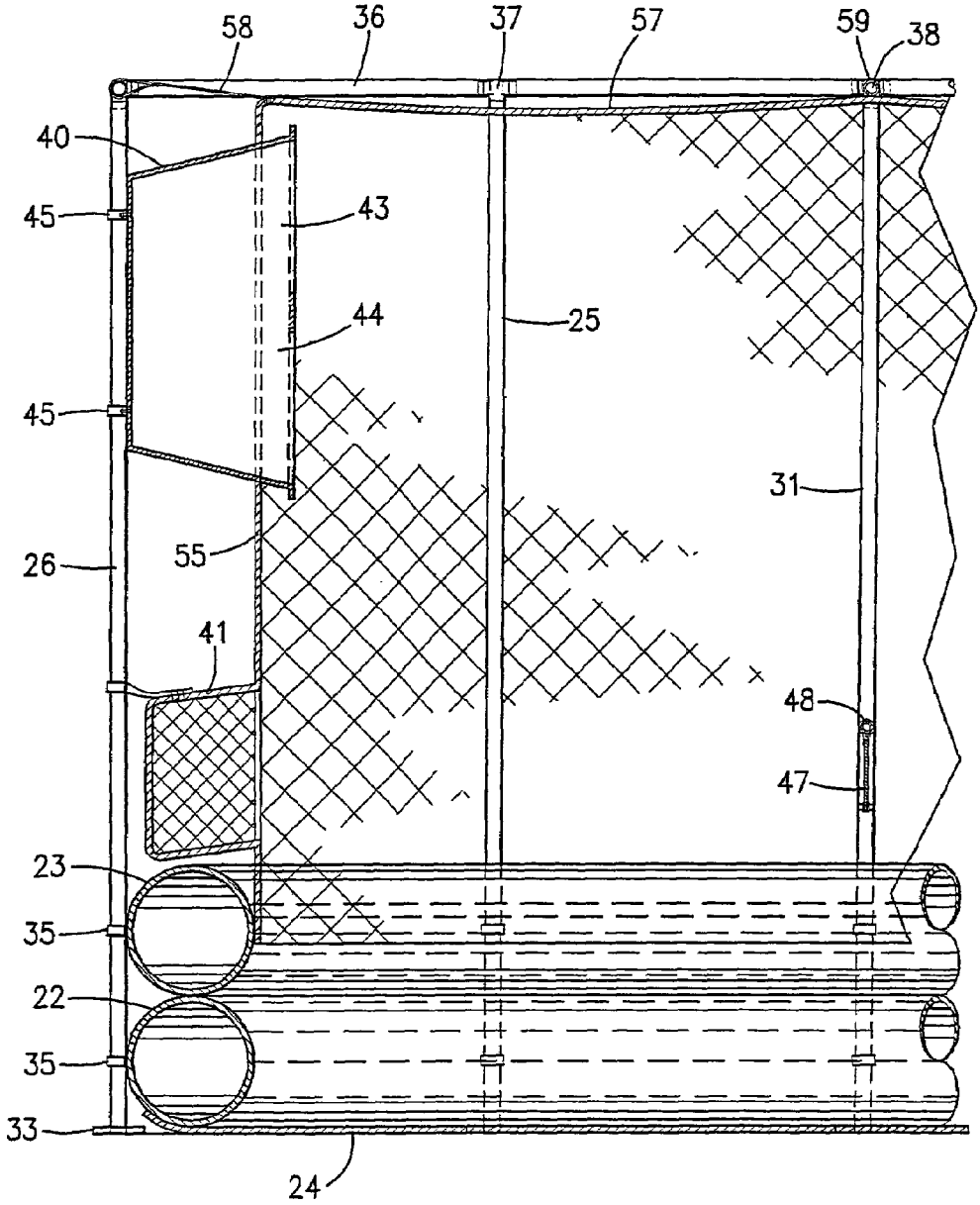
Figure 3:
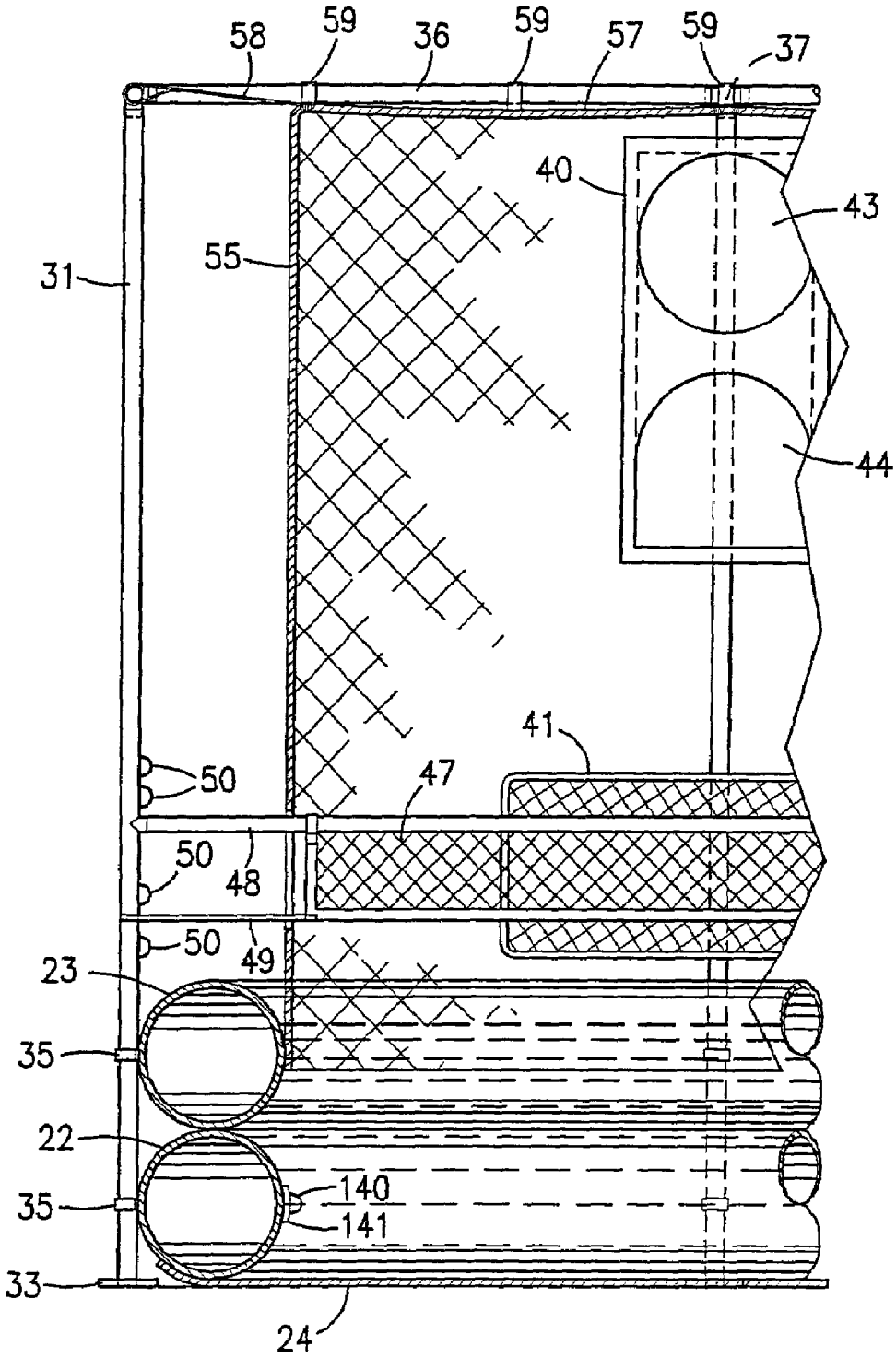
Figure 4:
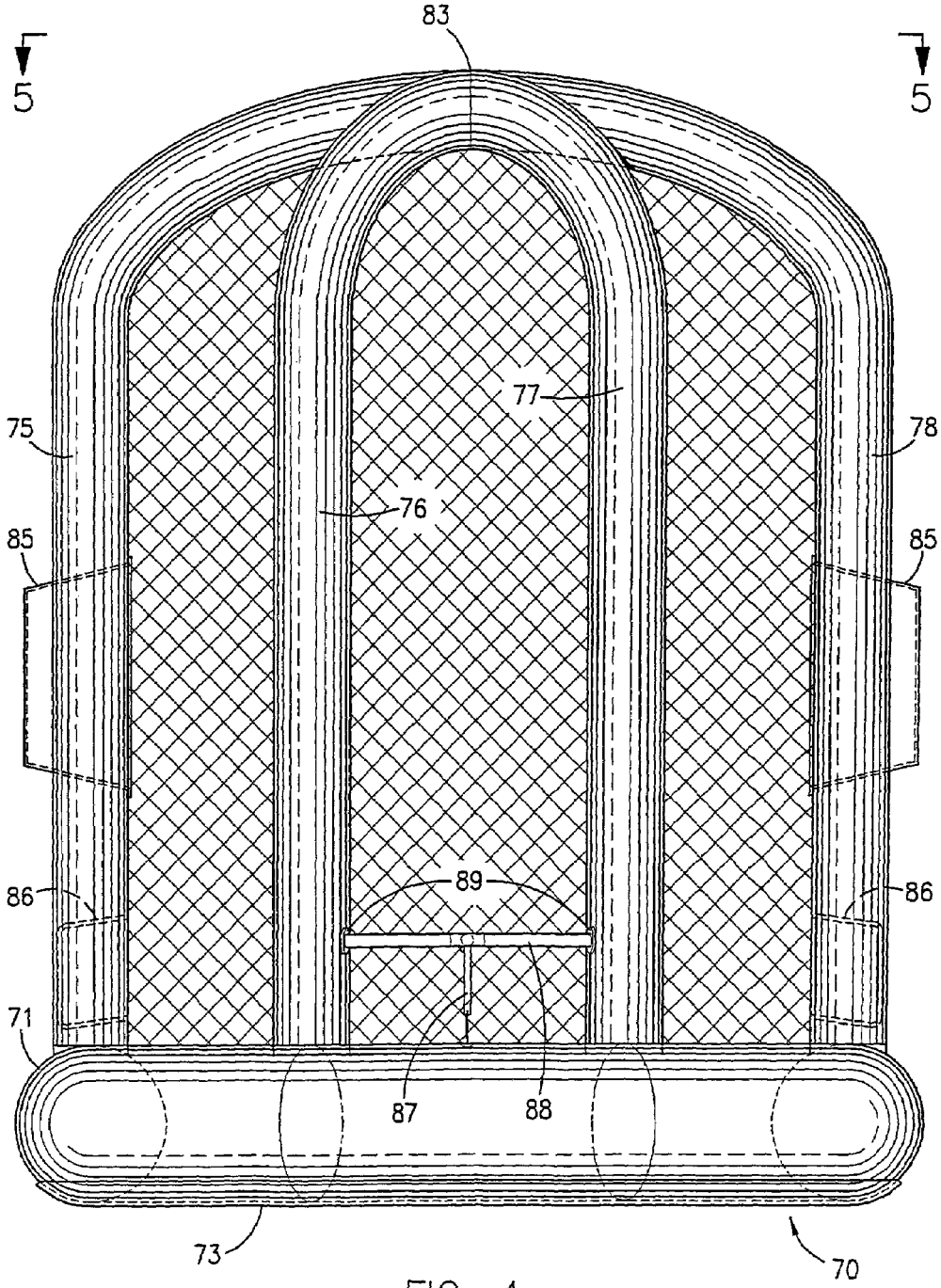
Figure 5:
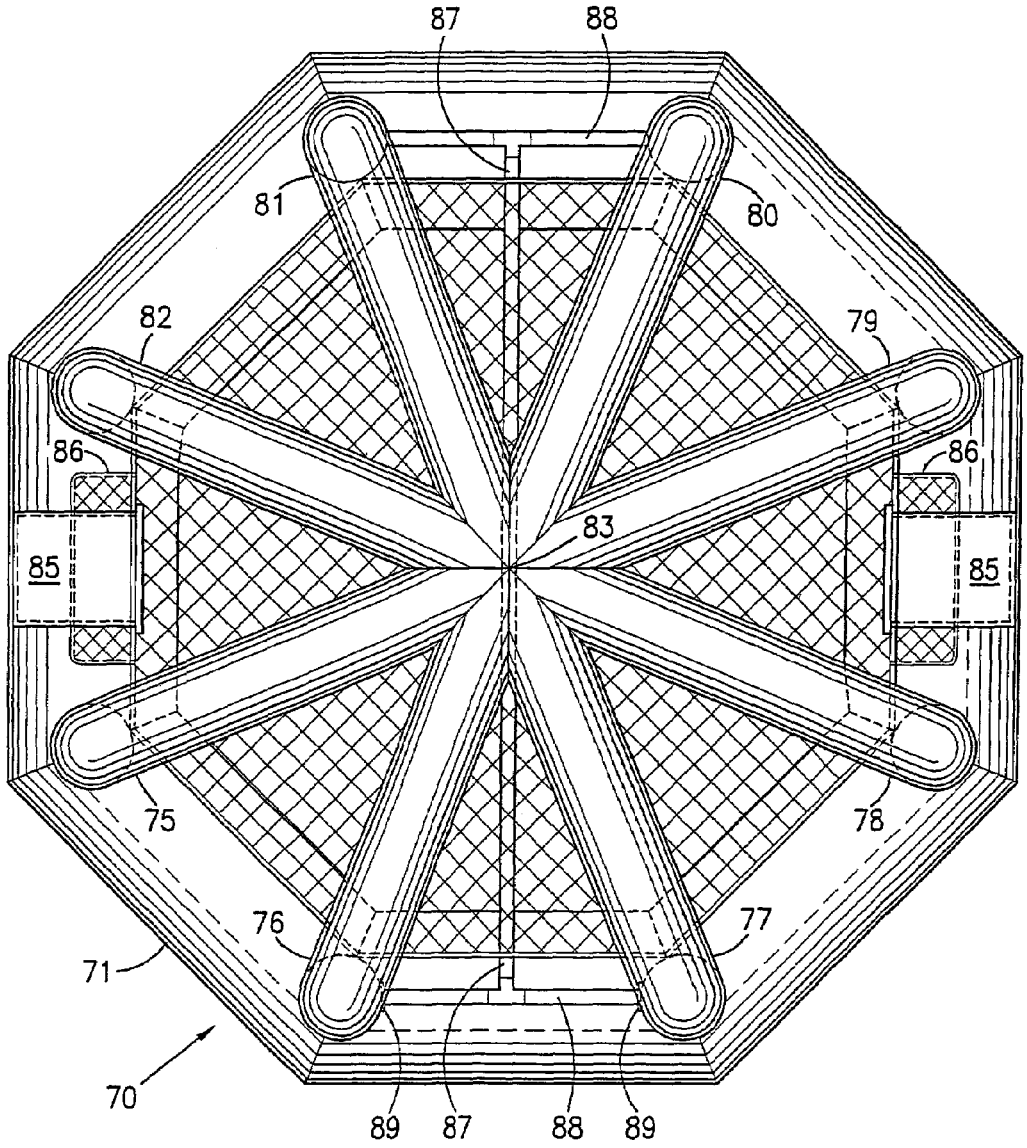
Figure 6:
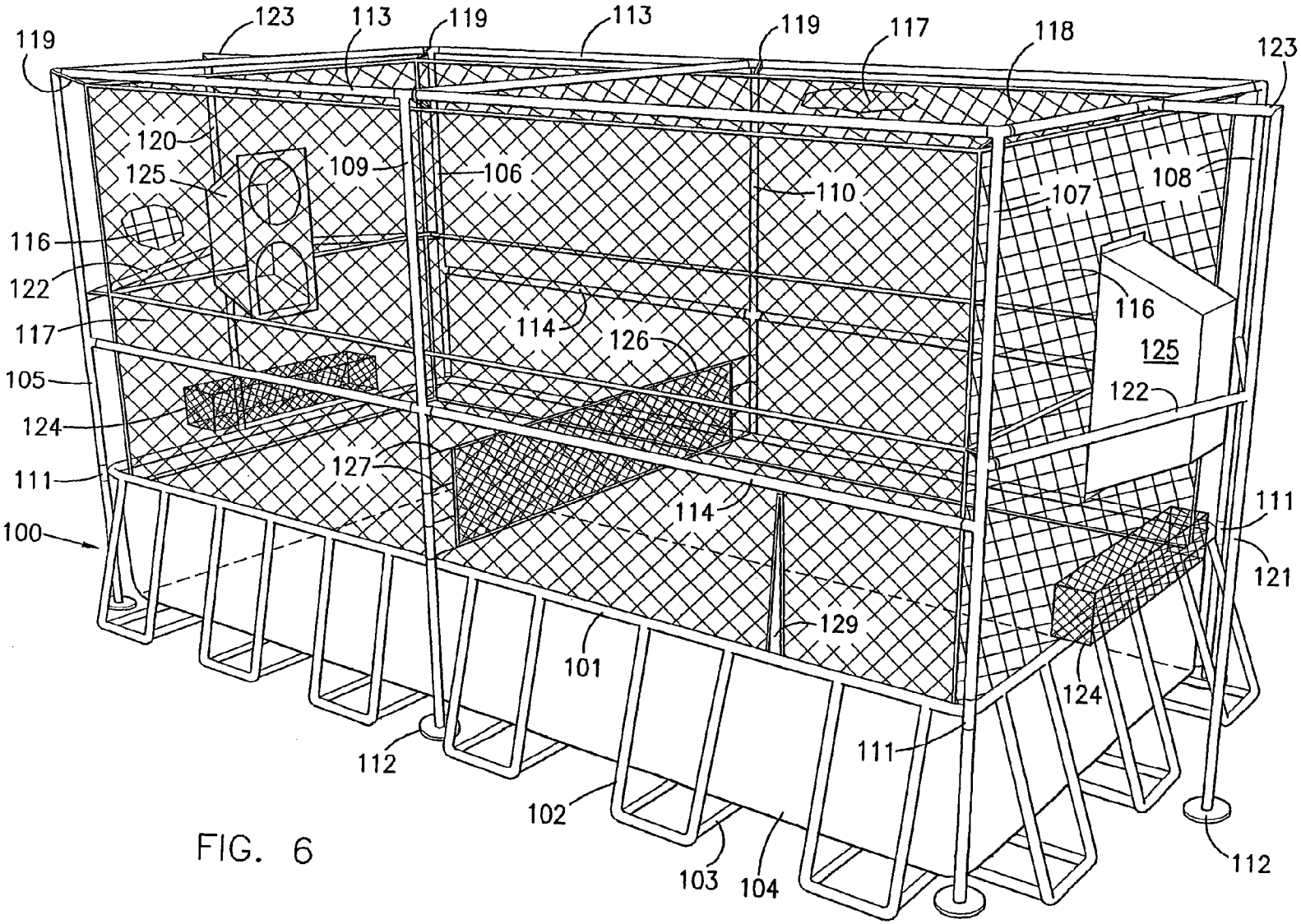
Figure 7:
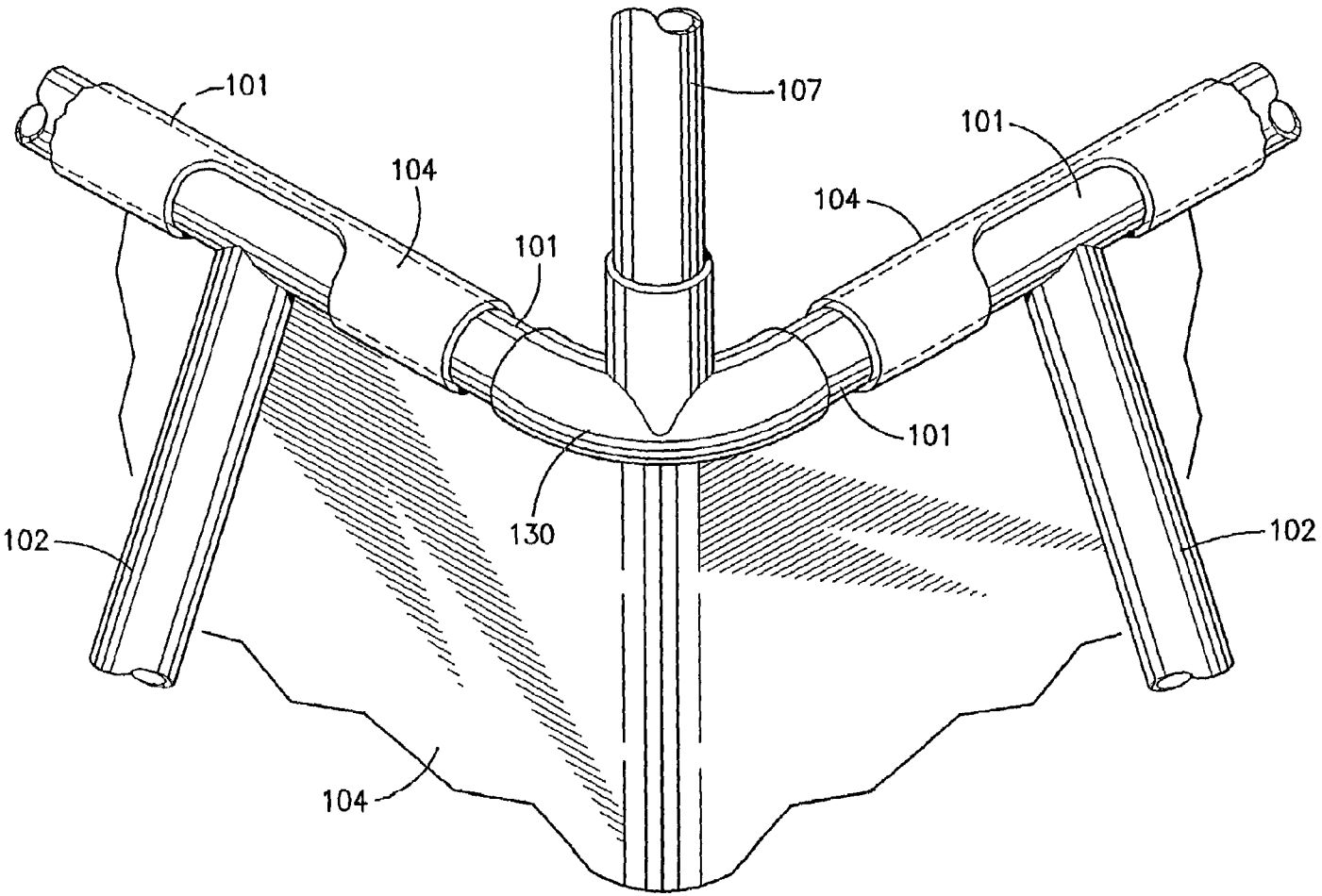
Figure 8:
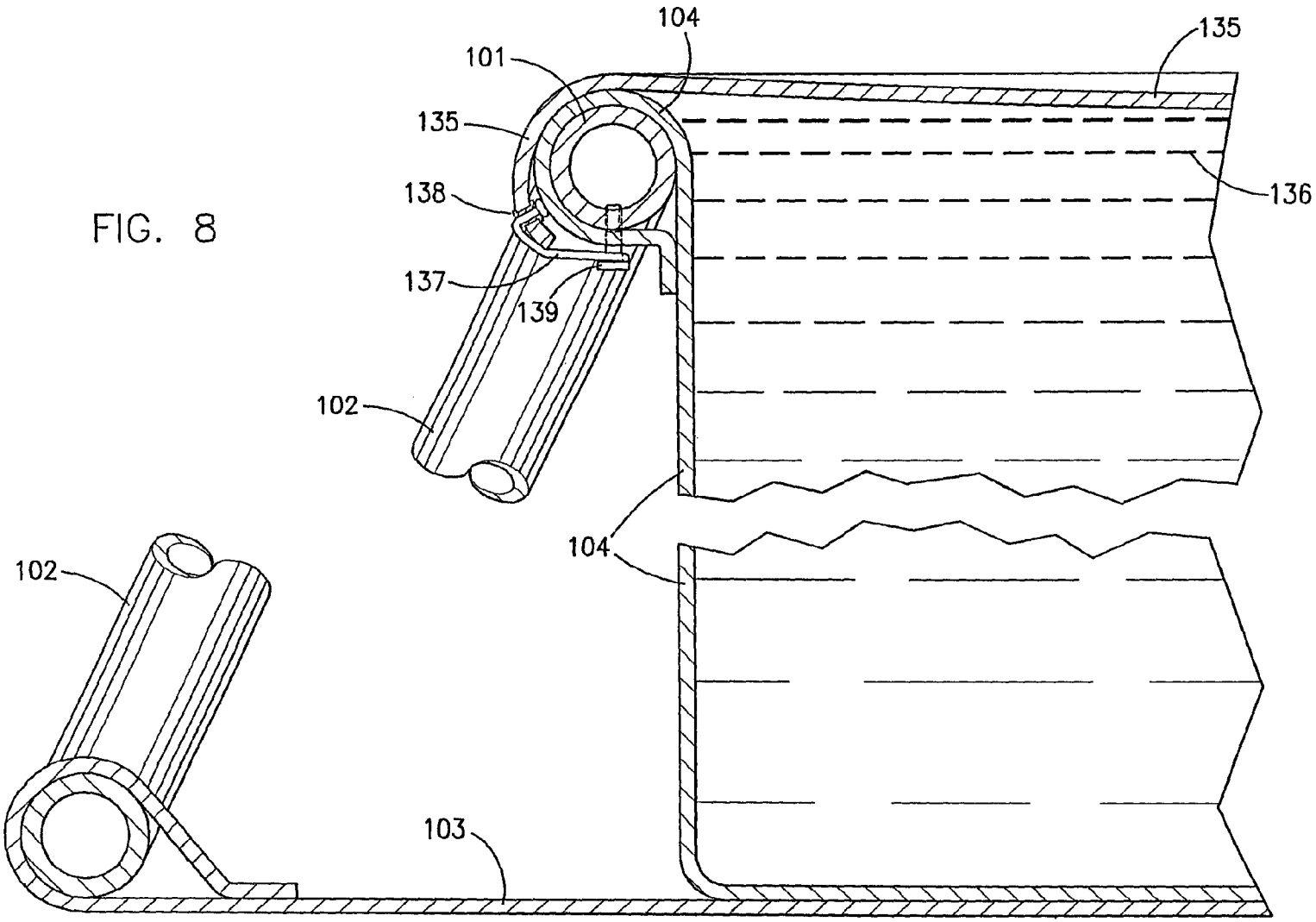

In the accompanying drawings, which show the best mode currently contemplated for carrying out the invention:

FIG. 1 is a perspective view of an above ground swimming pool with inflatable sides and showing a substantially rigid frame of the invention;

FIG. 2, a fragmentary vertical section taken on the line 2—2 of FIG. 1 showing attachment of a support member to the side of the pool;

FIG. 3, a fragmentary vertical section taken on the line 3—3 of FIG. 1;

FIG. 4, a perspective view of an above ground swimming pool with inflatable sides and showing inflatable support members;

FIG. 5, a top plan view of the pool of FIG. 4;

FIG. 6, a perspective view of an above ground swimming pool with sides supported by a rigid frame, and showing a substantially rigid frame of the invention;

FIG. 7, a fragmentary side elevation of a corner of the pool of FIG. 7, showing an alternate attachment of the support member; and FIG. 8, a fragmentary section of a pool of the invention similar to that shown in FIG. 7, but with a cover over the water to provide a unique playing surface.

DETAILED DESCRIPTION OF THE ILLUSTRATED EMBODIMENTS

The invention provides supporting members spaced around a swimming pool to support sport apparatus such as a volleyball net extending across the middle of the pool and/or basketball, water polo, aeroball, or similar type goals at opposite ends of the pool. The supporting members also support netting material which extends around at least portions of the periphery of the pool to form backstops to prevent loose sport apparatus used in conjunction with the supported sport apparatus in play of the sport involved, such as a ball, from leaving the pool. While it is presently preferred that the netting material extend entirely about the periphery of the pool to completely enclose the pool, the netting material could be provided at the opposite ends of the pool where a ball is most likely to leave the pool.

FIGS. 1 to 3 show an oval or elliptical, above ground swimming pool 20 with inflatable sides 21 made up of two independent inflatable tubes 22 and 23 secured and sealed together. A bottom 24 of plastic sheet material is sealed to the bottom of lower tube 22 to form, with the side wall tubes 22 and 23 a sealed water holding pool. While two tubes 22 and 23 are shown, a pool could be formed using a single side wall tube or more than two tubes, such as three, four, or more tubes. It is currently preferred that the wall be high enough to hold between three and four feet of water, although a shallower pool could be used where the principal use of the pool is for game playing and wading rather than swimming, and where it is desired to have shallower water for game playing.

Substantially rigid end support members 25, 26, 27, 28, 29, and 30, and intermediate support members 31 and 32 are secured to the sides 21 and extend above the top of the pool. Support members 25–32 may each include a bottom foot 33 which rests on the ground on which the pool rests to support the support member vertically. Alternatively, the support members could be received and supported in receiving pockets, not shown, secured to the side wall. Sleeves 35 hold and position support members 25–32 with respect to the wall 21. The tops of support members 25–32 are secured together by top member 36 which connects the tops of support members 25–32 to form a substantially rigid frame. The frame members may be connected in any suitable manner as with pipe couplings 37. A central cross member 38 may be included to increase the rigidity of the frame and help support netting material. End support members 26 and 29 support end goals such as end aeroball goals 40 and/or water polo goals 41. It should be noted that such goals will normally be provided at opposite ends of the pool and are shown in FIGS. 2 and 3 as at opposite ends, but, for clarity, only Aeroball goal 40 is shown and at only one end in FIG. 1. Aeroball goals 40 provide an opening 43 into which a ball is to be shot and the ball then returns through opening 44. Traditional basketball hoops could be used rather than the aeroball goals 40. The goals and/or basketball hoops are secured to support members 26 and 29 in any suitable manner such as by brackets 45. Rather than water polo goals 41 being supported by end support members 26 and 29, the goal 41 can be supported by and be formed as part of the netting material to be described, as shown in FIG. 2. Volleyball net 47 is secured between intermediate support members 31 and 32. For securing the net, a rigid net pole 48 can be secured to intermediate support members 31 and 32 with net 47 secured such as by ties or sleeves to pole 48 to hang down therefrom. Ties 49 at the bottom of the net can be tied around intermediate support members 31 and 32 to keep the net open. Alternately, connectors, such as hooks or "D" rings 50, may be secured to intermediate support members 30 and 31 to provide easy connecting points for ties from the volleyball net 47, and similar connectors may be provided along the other support members 25–30 and top member 36. Such connectors may be used for supporting various other sport apparatus, such as goals or nets, and netting material as desired.

Netting 55 is hung between respective support members 25–32 and forms a backstop around the pool so if a ball is thrown and misses the goal, the ball is retained by the netting and returned to the pool, or if a ball is hit or deflected to the side, it also returns to the water and does not pass out of the pool. The ball does not pass over the side of the pool to land outside the pool to require someone to get out of the pool to retrieve the ball. It is presently preferred that the netting be located on the inside of the frame and extend into the water to ensure that a ball hitting the net will be returned to the water. However, the netting could be on the outside of the frame but secured to it to also ensure that the ball returns to the water. If desired, top netting 57 may also be provided to fully enclose the pool. The vertical netting 55 and top netting 57 can be formed into an oval configuration and hung from the top member 36 and cross member 38 inside the frame to hang down to the water inside support members 25–32, or over the top member 36 and down over the support members 25–32. The netting may be secured by connecting it to various connectors on the various support members, or by ties or hook and loop fasteners 58 secured to the netting material and tied or otherwise wrapped around and secured to top member 36 and by ties or hook and loop fasteners 59 secured to cross member 38. A cut 60 in side netting 56 forms an entrance opening.

A set of steps or a ladder will generally be provided to allow easy access to the pool. Here an inflatable tube 61 is secured to inflatable tube 22 to provide a step up and over the pool side at the location of the cut 60 so a user can climb the step and move over the wall and into the pool. Hand grips 62 can be provided at the entrance. Various other steps as are commonly used with such pools may be used.

FIGS. 4 and 5 show another embodiment of an inflatable pool 70. Pool 70 is of octagonal shape with the side wall formed of a single inflatable tube 71. A sheet of material 73 forms the bottom of the pool. In the embodiment of FIGS. 4 and 5, the supporting members 75–82 are also inflatable tubes and are attached to the top of inflatable side tube 71 to extend upwardly therefrom. In this embodiment, the support members are joined together over the center of the pool as shown at 83. Each support member 75–82 may be a separate air tube so that a leak in one support member does not release the air from all members. Goals, such as basketball hoops, areoball goals 85, and/or water polo goals 86 may be secured at opposite sides of the pool, and a volleyball net 87 can be placed across the pool as described for the pool of FIGS. 1–3. Frame 88 is provided to support volleyball net 87. Connectors 85 are secured to the inflatable support members for use in securing nets, goals, and netting material to the support members.

FIG. 6 shows an embodiment of the invention applied to an above ground pool 100 having a side frame which includes a rigid top rail 101 and rigid U-shaped leg assemblies 102 secured to the top rail 101 and supporting top rail 101 above the ground. Straps 103 are connected between the bottom of opposite leg assemblies 102 to stabilize them and keep them from rotating. Plastic fabric reinforced sheet material 104, such as a reinforced vinyl material, is formed into the pool shape, here shown as a rectangular box shape, with the top open edges of the sheet material supported by rigid top rail 101. Such pools are currently commercially available in various sizes under the trademark LEGACY POOLS from Portable Pools Inc., Laguna Beach, Calif.

Vertical support members 105–110 extend upwardly above pool 100. These support members are held in position by sleeves 111 attached to top rail 101. The support members 105–110 are held vertically by bases or feet 112 on the bottom of each support member which rest on the ground. Top members 113 and intermediate members 114 connect and stabilize vertical support members 105–110. End netting 116, side netting 117, and top netting 118 is provided to enclose pool 100. The end, side, and top netting can be formed into a rectangular configuration and hung from the top members 113 inside the frame to hang down to the water inside support members 105–110, or over the top members 113 and down over the support members 105–110. The netting may be secured by connecting it to various connectors on the various support members and top members, or by ties or hook and loop fasteners such as fasteners 119 secured to the netting material and tied or otherwise wrapped around and secured to top members 113. The netting may also be secured to intermediate members 114. End goal support members 120 and 121 may also be provided with intermediate lateral connecting members 122 and top connecting member 123. End goal supporting members 120 and 121 support end goals such as end aeroball goals 125. End water polo goals or other desired goals, such as regular basketball hoops, may also or alternately be provided, but are not shown. Connectors, such as hooks or "D" loops may be secured along any of the support members and other members and connectors to provide easy connections for netting and sport apparatus such as goals and nets. A volleyball net 126 is stretched between support members 109 and 110 and secured as by ties 127. A slit 129 in side netting 117 provides an entrance to the pool. Steps of any desired configuration, not shown, may be positioned between pool supporting legs 102 in line with entrance slit 129.

Rather than vertical support members 105–110 being supported vertically by feet 112, such members may be secured to the pool in various other ways, such as, for example, directly to top rail 101 and supported thereon by a pipe fitting 130, FIG. 7.

FIG. 8 shows an embodiment using the pool 100 of FIG. 6 with frame top rail 101. In this embodiment, however, rather than the players being in the water in the pool, a cover 135 is placed over the water 136 and secured to or around top rail 101 to provide a play surface on top of the water in the pool in the nature of a large water bed. The cover 135 may be fabric reinforced or may include supporting webbing on the bottom side for added strength. The cover edges are preferably pulled over and secured over the top of the rigid top frame 101 so that any water that is forced out of the pool by the play on top of cover 135 is directed to the side of the pool and onto the ground and does not flow back onto the cover 135. The cover may be secured over the pool in various way, as for example using elastic cord 136 extending through grommets in the cover and secured around hooks 136 mounted on top rail 101, or by direct connection to top rail 101. The connection will depend upon the desired effect to be achieved. Rather than attachment to the top rail 101, attachment could be made to legs 102. This cover provides a unique playing surface for the various games which can be played with the pool of the invention.

In addition to the connectors provided on the support members and connectors for connecting sport apparatus and netting, various connectors can be secured in the pool itself for connecting sport apparatus to maintain it in position in the pool or for connecting users of the pool in position in the pool. For example, rings 140, FIG. 3, can be secured by a piece of plastic material 141 glued or otherwise bonded to pool side wall tube 22. Similar rings or other hooks can be secured in pool 100 of FIG. 6.

While the invention has been shown with above ground swimming pools, it can also easily be used with in ground swimming pools. In such instance, the supporting frame may be secured to the pool deck. Alternatively, for either type of pool, the frame could be constructed as a free standing frame placed over the pool. In addition, while netting has been shown as extending around the entire periphery of the pool and over the top of the pool, it could be provided to extend only around the ends of the pool with the goals or along other portions of the periphery most likely to have balls or other loose sport apparatus pass thereover.

Further, while the material partially or fully enclosing the pool has been described as netting material which will generally be a porous material, an impervious material could be used such as a plastic sheeting material. Such impervious material is to be considered netting material for purposes of the invention and such impervious material may be used in cold climates to keep heat in the pool enclosure formed by the invention when the pool is fully enclosed. This allows the pool to be used during cold weather. Further, open porous material may be used during hot weather and be covered with impervious material during cold weather.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A sports play pool, comprising:

pool means holding water to create a water pool wherein the pool means is an above ground swimming pool with inflatable sides;

frame means extending upwardly from the pool means to provide a supporting structure above the pool means wherein the frame means includes inflatable tubular support members secured to and extending upwardly from the top of the inflatable sides of the pool, said support members curving as they extend upwardly from the inflatable sides of the pool to which they are secured and coming together over the pool;

sport apparatus means secured to the frame means whereby the sport apparatus is attached to and supported above the pool means by the frame means wherein the sport apparatus means includes attachment devices secured to the support members for attachment of the sport apparatus to the support members to be supported in a play position above the pool;

netting means supported by the frame means around at least a portion of the periphery of the pool to form backstops to prevent loose sport apparatus used in conjunction with the supported sport apparatus in play of the sport involved from leaving the pool wherein the netting means is netting material supported by the support members around at least a portion of the periphery of the pool; and a cover secured over the water in the pool means and resting on the water to create a sports play surface on the cover.

2. A sports play pool according to claim 1, wherein the sport apparatus includes goals at opposite sides of the pool and the netting material extends along said opposite sides of the pool.

3. A sports play pool according to claim 2, wherein the netting material extends along the entire periphery of the pool to enclose it.

4. A sports play pool according to claim 3, wherein netting material extends across the top of the pool.

5. A sports play pool according to claim 1, additionally including connectors secured to the support members for selective connection of the sport apparatus and netting.

6. A sports play pool according to claim 1, additionally including connectors secured in the pool for connection of sport apparatus.

7. A sports play pool, comprising:

pool means holding water to create a water pool wherein the pool means is an above ground swimming pool with inflatable sides;

frame means extending upwardly from the pool means to provide a supporting structure above the pool means wherein the frame means additionally includes sleeves secured to the inflatable sides of the pool, and substantially rigid support members passing through the sleeves secured to the inflatable sides of the pool to thereby secure them to the inflatable sides of the pool whereby they extend upwardly from the pool;

sport apparatus means secured to the frame means whereby the sport apparatus is attached to and supported above the pool means by the frame means;

netting means supported by the frame means around at least a portion of the periphery of the pool to form backstops to prevent loose sport apparatus used in conjunction with the supported sport apparatus in play of the sport involved from leaving the pool; and a cover secured over the water in the pool means and resting on the water to create a sports play surface on the cover.

8. A sports play pool according to claim 7, wherein the sport apparatus includes goals at opposite sides of the pool and the netting material extends along said opposite sides of the pool.

9. A sports play pool according to claim 8, wherein the netting material extends along the entire periphery of the pool to enclose it.

10. A sports play pool according to claim 9, wherein netting material extends across the top of the pool.

11. A sports play pool according to claim 7, additionally including connectors secured to the support members for selective connection of the sport apparatus and netting.

* * * * *